US008899219B2

(12) United States Patent
Macy

(10) Patent No.: US 8,899,219 B2
(45) Date of Patent: Dec. 2, 2014

(54) PROJECTILE LAUNCHER STRUCTURED IN SHOTGUN CONFIGURATION

(71) Applicant: Real Action Paintball, Inc., San Jose, CA (US)

(72) Inventor: Omar Alonso Macy, San Jose, CA (US)

(73) Assignee: Real Action Paintball, Inc., Gilroy, CA (US)

( * ) Notice: Subject to any disclaimer, the term of this patent is extended or adjusted under 35 U.S.C. 154(b) by 40 days.

(21) Appl. No.: 13/677,185

(22) Filed: Nov. 14, 2012

(65) Prior Publication Data

US 2014/0130787 A1 May 15, 2014

(51) Int. Cl.
*F41B 11/62* (2013.01)
*F41B 11/51* (2013.01)
*F41B 11/55* (2013.01)

(52) U.S. Cl.
CPC ..... *F41B 11/51* (2013.01); *F41B 11/55* (2013.01)
USPC ..... 124/73; 124/71; 124/72

(58) Field of Classification Search
CPC ..... F41B 11/50; F41B 11/51; F41B 11/62; F41B 11/70; F41B 11/55; F41B 11/00
USPC ..... 124/71–77
See application file for complete search history.

(56) References Cited

U.S. PATENT DOCUMENTS

| | | | | |
|---|---|---|---|---|
| 7,765,999 | B1 * | 8/2010 | Stephens et al. | 124/73 |
| 7,770,571 | B2 * | 8/2010 | Tippmann et al. | 124/73 |
| D636,043 | S * | 4/2011 | Olsen et al. | D22/108 |
| 8,166,961 | B2 * | 5/2012 | Macy | 124/73 |
| 8,333,181 | B1 * | 12/2012 | Rice | 124/73 |
| 8,464,454 | B2 * | 6/2013 | Martin et al. | 42/69.01 |
| 8,578,919 | B2 * | 11/2013 | Macy et al. | 124/45 |
| 8,578,921 | B2 * | 11/2013 | Macy | 124/73 |
| 8,671,927 | B1 * | 3/2014 | Macy | 124/73 |
| 8,683,990 | B2 * | 4/2014 | Macy | 124/73 |
| 2007/0215135 | A1 * | 9/2007 | Campo | 124/77 |
| 2008/0060630 | A1 * | 3/2008 | Halmone | 124/73 |
| 2008/0078971 | A1 * | 4/2008 | Quinn et al. | 251/205 |
| 2008/0127957 | A1 * | 6/2008 | Campo | 124/32 |
| 2009/0056693 | A1 * | 3/2009 | Pedicini et al. | 124/73 |
| 2009/0114201 | A1 * | 5/2009 | Halmone | 124/74 |
| 2014/0060512 | A1 * | 3/2014 | Macy | 124/73 |

* cited by examiner

*Primary Examiner* — Michael David
(74) *Attorney, Agent, or Firm* — James Wu; JW Law Group

(57) ABSTRACT

A projectile launching device or launcher includes a receiver, a forestock, a trigger mechanism, and a trigger extension cable. The receiver, in one example, includes a valve, a striker, and a bolt, and is able to launch a projectile such as a paintball via pressurized gas. The loading tube is situated on the top of a barrel coupled to the receiver. The trigger guard, in one embodiment, includes a cable channel facilitating a flexible passage for the trigger extension cable. The trigger extension cable passes through the cable channel and provides a flexible linkage between the trigger and a latch wherein the latch is used to release the sear to trigger a launch.

22 Claims, 13 Drawing Sheets

PROJECTILE LAUNCHER STRUCTURED IN SHOTGUN CONFIGURATION

FIELD

The present invention relates to projectile propelling systems or apparatus. More specifically, the present invention relates to structure of a projectile launcher having a structure arrangement consistent with shotgun configurations.

BACKGROUND

During training exercises and/or sporting events, using nonlethal weapons are typically preferred over lethal and/or deadly weapons. Accordingly, nonlethal weapons or apparatus such as paintball guns have become more popular in recent years for various applications. For example, paintball guns can be used in trainings, such as trainings for soldiers, policemen, security personals, and/or athletic participants. The effectiveness and success of training, however, may depend on how closely the paintball guns resemble the intended real firearms.

A drawback associated with a conventional paintball gun or marker is that the physical structure and appearance of a typical paintball marker are different from real firearms and/or guns. Since a conventional structure of a paintball marker is different from the real firearms, operations as well as maintenance of a paintball marker can also be different from real firearms, guns, and/or shotguns. As such, without close resemblance of real firearms, nonlethal weapons such as paintball guns or markers have their limitations and/or shortcomings.

SUMMARY

A projectile launching device such as a paintball marker, which is arranged and structured in a shotgun-like configuration, is disclosed. The projectile launching device or launcher includes a receiver, a forestock, a trigger mechanism, and a trigger extension cable. The receiver, in one example, includes a valve, a striker, and a bolt, and is able to launch a projectile such as a paintball via pressurized gas. The loading tube is situated on the top of a barrel coupled to the receiver. The trigger mechanism coupled to the bottom of receiver includes a trigger, a trigger extension cable, and a trigger guard. The trigger guard, in one embodiment, includes a cable channel facilitating a flexible passage for the trigger extension cable. The trigger extension cable passes through the cable channel and provides a flexible linkage between the trigger and a latch wherein the latch is used to release the sear to trigger a launch.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1A:
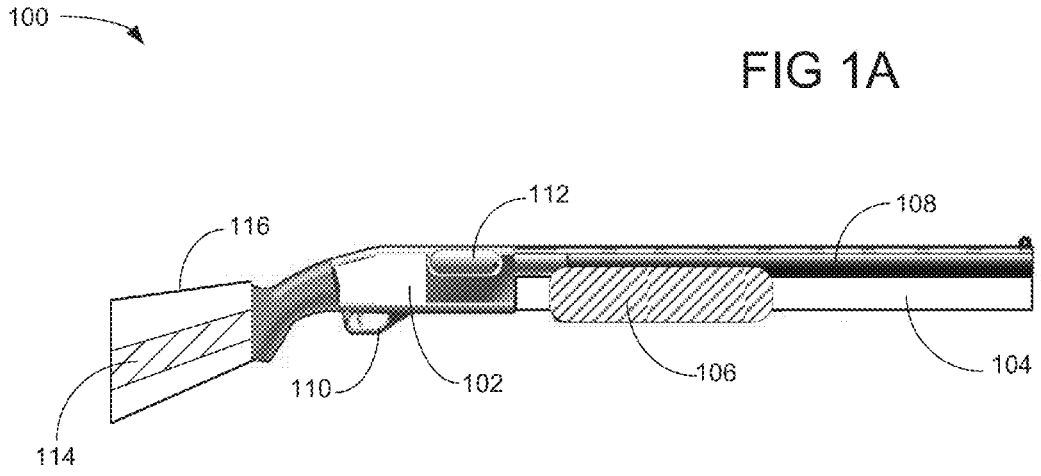
FIGS. 1A-B illustrate diagrams showing exemplary projectile launchers arranged and structured in shotgun-like configurations in accordance with one embodiment of the present invention.

Exemplary embodiment(s) of the present invention is described herein in the context of a method, system and apparatus of providing a paintball launcher arranged and constructed in a shotgun-like configuration.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Furthermore, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

One embodiment of the presently claimed invention discloses a projectile launching device such as a paintball gun which is arranged and structured in a shotgun-like configuration. The projectile launching device includes a receiver, a forestock, a trigger mechanism, and a trigger extension cable. The receiver, in one example, includes a valve, a striker, and a bolt, and is able to launch a projectile such as a paintball via pressurized gas. The loading tube is situated on the top of a barrel coupled to the receiver. The trigger mechanism, which is coupled to the bottom of receiver, includes a trigger, a trigger extension cable, and a trigger guard which includes a cable channel. The trigger extension cable passes through the cable channel and provides a flexible linkage between the trigger and a latch which is used to release the sear to trigger a launch of a projectile.

FIG. 1A illustrates a diagram showing exemplary projectile launcher 100 arranged and structured in a shotgun-like configuration in accordance with one embodiment of the present invention. Launcher 100 includes a receiver 102, a barrel 104, a forestock 106, a loading tube 108, a trigger mechanism 110, and a buttstock 116. Buttstock 116, also known as shoulder stock or stock, includes a gas source or pressurized gas tank 114. Buttstock 116 can be held by a user against his or her shoulder when shooting. It should be noted that the underlying concept of the exemplary embodiment(s) of the present invention would not change if one or more components (or units) were added to or removed from launcher 100.

Gas source or tank 114, in one aspect, supplies pressurized gas for launching a projectile such as a paintball. Gas source 114 may be a nitrogen tank, a carbon dioxide (CO2) canister, and/or a compressed air canister. In an alternative example, the projectile launcher may include an external gas tank(s) which for example may be mounted beneath the assembly or receiver.

Projectile launcher 100, also known as projectile launching device or paintball marker, includes receiver 102 that includes a valve, a striker, and a bolt. The valve, striker, and bolt are arranged in such a way that is capable of launching a projectile via the pressurized gas. Loading tube 108, in one aspect, is situated on top of barrel 104 and is able to store a predefined number of projectiles. For example, the predefined number of projectiles can be anywhere between 10 to 50 paintballs. Loading tube 108 and barrel 104 are coupled to receiver 102.

Trigger mechanism 110 containing a trigger and a trigger guard is coupled to the bottom side of receiver 102. The trigger guard, in one embodiment, includes a cable channel which allows a trigger extension cable to pass through providing a flexible linkage between the trigger and a latch. The trigger guard is a device to guard the trigger from accidentally being pulled. In one embodiment, the trigger guard is configured to have two ends wherein the first end of trigger guard is coupled to a latch and the second end of trigger guard is coupled to a trigger. The latch, in one example, is capable of releasing a sear to launch a projectile when the trigger is squeezed.

Receiver 102, in one embodiment, further includes a two-stage cocking and loading ("TCL") device 112, which may be coupled to loading tube 104. TCL device 112, in one embodiment, is used to provide a cocking function as well as a loading function of ammunition. It should be noted that the ammunition may include paintball, gyroscopic paint projectile, object, colored markings, and the like. TCL device 112, in one embodiment, includes a loading door, a pre-chamber loader, and a cocking element wherein the cocking element is able to cock the striker to a ready-to-fire position. The pre-chamber loader, in one example, is able to pre-load a projectile or paintball in TCL device 112 from the loading tube before it is loaded into a loading chamber.

Launcher 100, in one embodiment, includes a forestock 106 which is attached to barrel 104 in such a way that forestock 106 is able to slide along barrel 104 for pump actions. A pump action indicates a back slide action and a forward slide action. In one embodiment, a back slide action of forestock 106 cocks the striker and a forward slide action of forestock 106 loads a fresh paintball or projectile into a firing chamber. Depending on the applications, forestock 106 and barrel 106 are configured to limit the sliding distance between a forward slide distance and a backward slide distance.

Barrel 104, which is connected to receiver 102, is configured as a track for forestock 106 to travel to facilitate a pumping function. Forestock 106, in one aspect, provides a linkage between forestock 106 and TCL device 112 whereby a pump action accomplishes a loading function as well as a cocking function. The forestock, in one aspect, is configured to have a grip which may be grabbed by a user to perform a pump action. In an alternative embodiment, TCL device 112 is capable of opening the loading door for resupplying ammunition in accordance with the pump action of forestock 106. Depending on the applications, loading tube 108 holds multiple paintballs through the loading door of TCL device 112.

An advantage of using projectile launcher 100 is that the launcher operates like a real shotgun while it launches a nonlethal projectile instead of a shotgun shell.

Figure 1B:
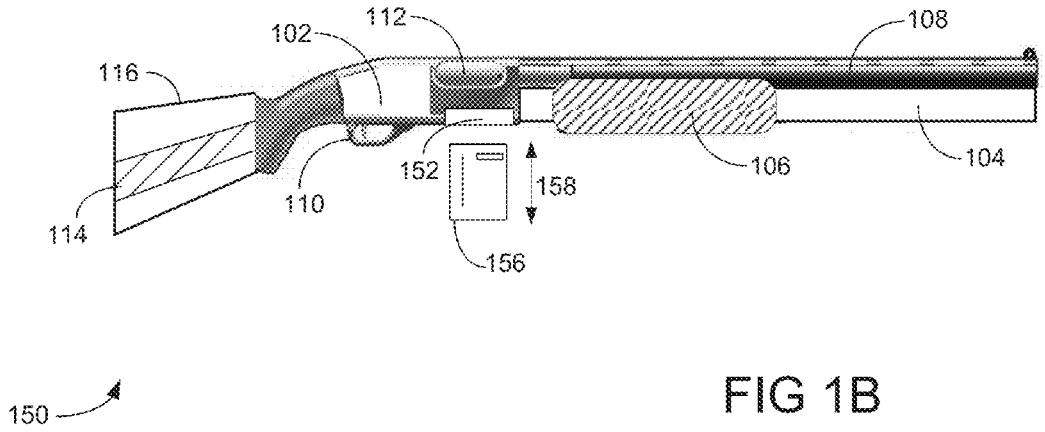

FIG. 1B illustrates an exemplary projectile launcher 150 arranged and structured in a shotgun-like configuration in accordance with one embodiment of the present invention. Launcher 150, which is similar to launcher 100 shown in FIG. 1A, includes a receiver 102, a barrel 104, a forestock 106, a loading tube 108, a trigger mechanism 110, and a buttstock 116. Launcher 150 further includes a magazine well 152 configured to receive a magazine containing ammunition. Magazine well 152, in one example, is coupled to the bottom side of receiver 102 adjacent to trigger mechanism 110 and is able to receive a projectile magazine containing fresh projectiles. An ammunition source selector, not shown in FIG. 1B, may be employed allowing a user to select sources of ammunition. For example, a user can select the source of paintballs from loading tube 108 or magazine 156.

Figure 2:
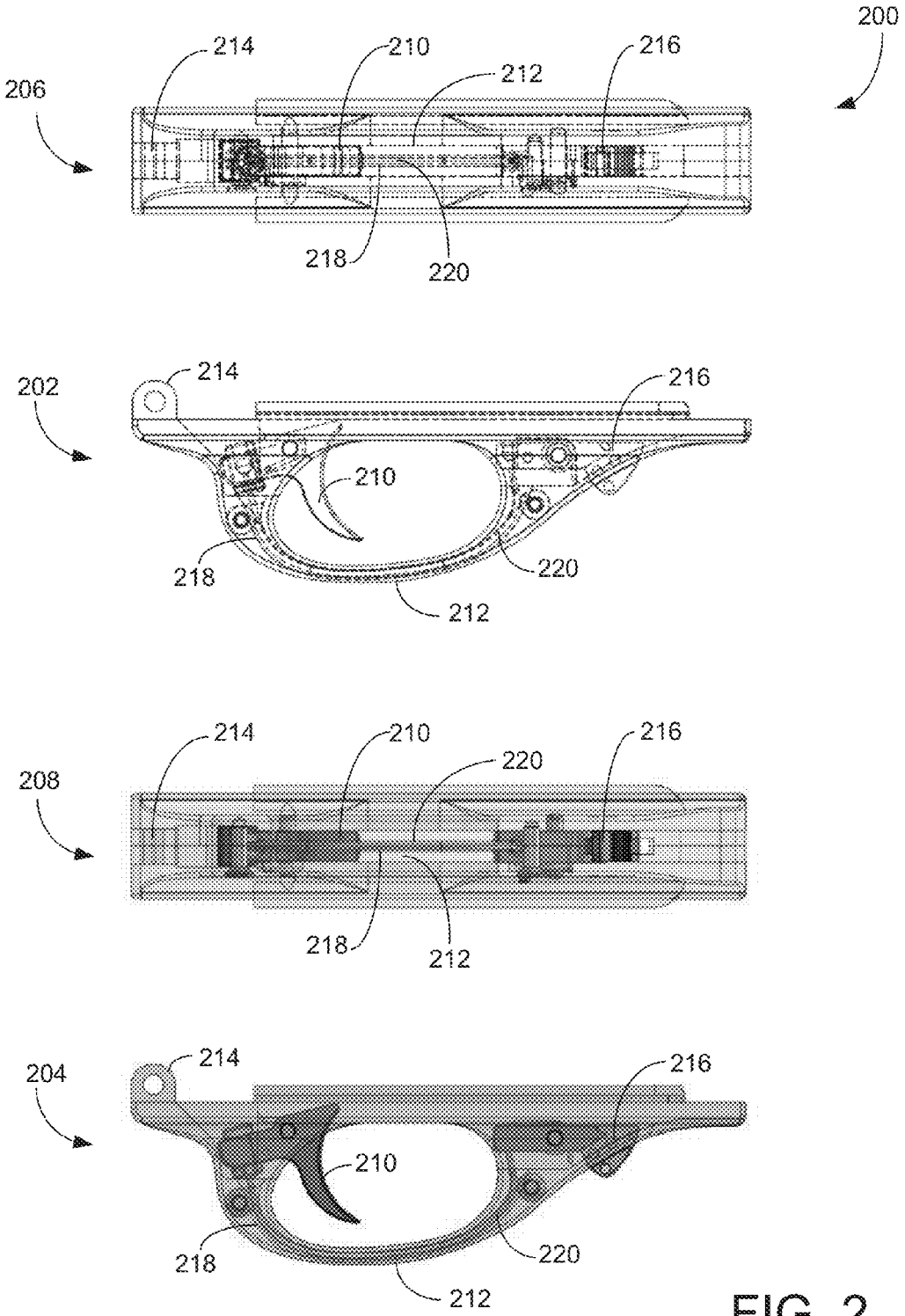
FIG. 2 is a diagram illustrating a trigger mechanism having a trigger extension cable for setting off a projectile launch in accordance with one embodiment of the present invention.

FIG. 2 shows a diagram 200 illustrating a trigger mechanism having a trigger extension cable for triggering a projectile launch in accordance with one embodiment of the present invention. Diagram 200 illustrates a mechanical drawing of trigger mechanism 202 and a top view of mechanical drawing of trigger mechanism 206. Diagram 200 also illustrates a transparent drawing of trigger mechanism 204 and the top view of transparent drawing 208. Trigger mechanism 202 or 204, in one aspect, includes a trigger 210, a trigger guard 212, and a latch 216, wherein trigger guard 212 further includes a cable channel 218. It should be noted that the underlying concept of the exemplary embodiment(s) of the present invention would not change if one or more components (or units) were added to or removed from diagram 200.

Trigger mechanisms 202-208 include a trigger extension cable 220 which is used to provide a flexible coupling between trigger 210 and latch 216. Trigger extension cable 220, in one aspect, includes a first end, a second end, and a body, wherein the first end is connected to trigger 210 and the second end is connected to latch 216. The body of trigger extension cable 220 is embedded in cable channel 218. It should be noted that trigger 210, trigger guard 212, trigger extension cable 220, latch 216, and sear are arranged in such a way that when trigger 210 is squeezed which pulls trigger extension cable 220 through trigger guard 212, latch 216, which is connected to the other end of trigger extension cable 220, triggers the sear (not shown in FIG. 2) to launch a paintball.

Trigger mechanism 202 or 204, in one example, may be attached to the bottom of receiver via fastener 214. Trigger guard 212 can be made of metal, alloy, composite material, and/or plastic material that surrounds trigger 210 to prevent trigger 210 to be accidentally pulled or touched. Similarly, the trigger extension cable can be made of steel, metal, alloy, plastic, polymer, or a combination of metal, polymer, and/or plastic.

An advantage of using trigger mechanism 202 or 204 having a trigger extension cable is that the trigger mechanism allows a trigger to be placed at a location similar to a real shotgun whereby structuring a projectile launcher that resembles a shotgun configuration becomes possible.

Figure 3:
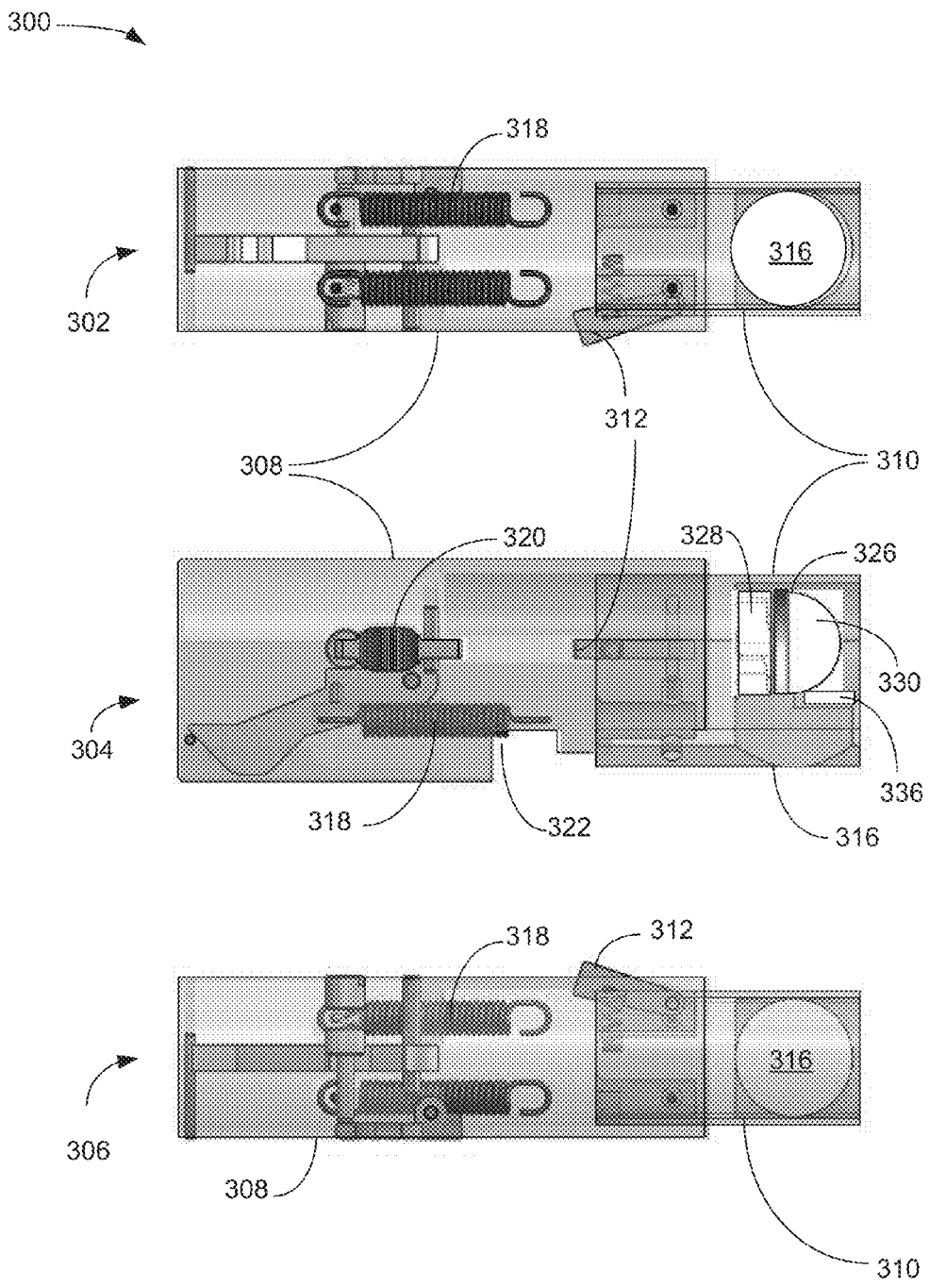
FIG. 3 is a diagram illustrating a two-stage cocking and loading ("TCL") device used to construct a shotgun-like projectile launcher in accordance with one embodiment of the present invention.

FIG. 3 is a diagram 300 illustrating a TCL device used to construct a shotgun-like projectile launcher in accordance with one embodiment of the present invention. Diagram 300 illustrates a bottom view of TCL device 302, a side view of TCL device 304, and a top view of TCL device 306. TCL device 302 or 304 or 306 includes a TCL frame 308 and a TCL extension 310. In one embodiment, the TCL device is connected to the forestock via connecting notch 322. When the forestock slides across the barrel, the TCL device also slides or moves with respect to the receiver. It should be noted that the underlying concept of the exemplary embodiment(s) of the present invention would not change if one or more components (or units) were added to or removed from diagram 300.

TCL frame 308, in one example, includes springs 318 and a TCL lock switch 320. TCL lock switch 320, in one aspect, allows a user to set a distance that the forestock can travel or slide. For example, a setting of relatively shorter distance indicates that the launcher is able to launch or fire projectiles or paintballs more rapidly. Alternatively, a setting of longer distance means that the launcher operates more like a shotgun. TCL frame 308 is configured to have sufficient room to allow TCL extension 310 to be completely fitted inside TCL frame 308.

TCL extension 310 includes a stopper 312, a feeding channel 316, and a pre-chamber guide 330. It should be noted that pre-chamber guide 330 can also be referred to as a pre-chamber loader. Stopper 312 is used to prevent TCL extension 310 to move inside of TCL frame 308 when stopper 312 is in contact with the inner wall of the receiver. Note that springs 318 are used to pull TCL extension 310 into TCL frame 308 when stopper 312 retracts.

The feeding channel 316, in one embodiment, is coupled to the loading tube, not shown in FIG. 3, and is able to supply a fresh projectile or paintball to the loading chamber when the forestock is pumped. In one embodiment, pre-chamber guide 330 is used to direct a projectile or paintball to be set in a correct orientation before it is being loaded into the loading chamber. For example, projectile 326 includes a head 330 and a tail 328 wherein tail 328 causes projectile 326 to spin after it leaves the muzzle. To properly launch such projectile, pre-chamber guild 336 is used to ascertain that the projectile such as projectile 326 is seated in a correct orientation.

A projectile launcher includes a receiver, a loading tube, and a TCL device 304 wherein the receiver houses a valve, a striker, and a bolt. TCL device 304, in one embodiment, is coupled to the loading tube and configured to providing cocking function. The TCL device further includes a loading door, a pre-chamber guide or loader 330, and a cocking element. The cocking element, not shown in FIG. 3, is able to cock the striker to a ready-to-fire position.

TCL frame 308 and TCL extension 310 provide a stage 1(one) operation which is configured to constrain sliding distance of a forestock over the barrel within a first predefined limitation. TCL frame 308 and TCL extension 310 facilitate a stage 2(two) operation which is configured to constrain sliding or travel distance of the forestock within a second predefined limitation. The stage one (1) operation allows a user to fire objects such as paintballs more rapidly while state 2 operation allows a user to operate the launcher more like a traditional shotgun. Switch 320 may be used to set or select stage one (1) or stage two (2) operations. It should be noted that additional stages may be added.

Figure 4:
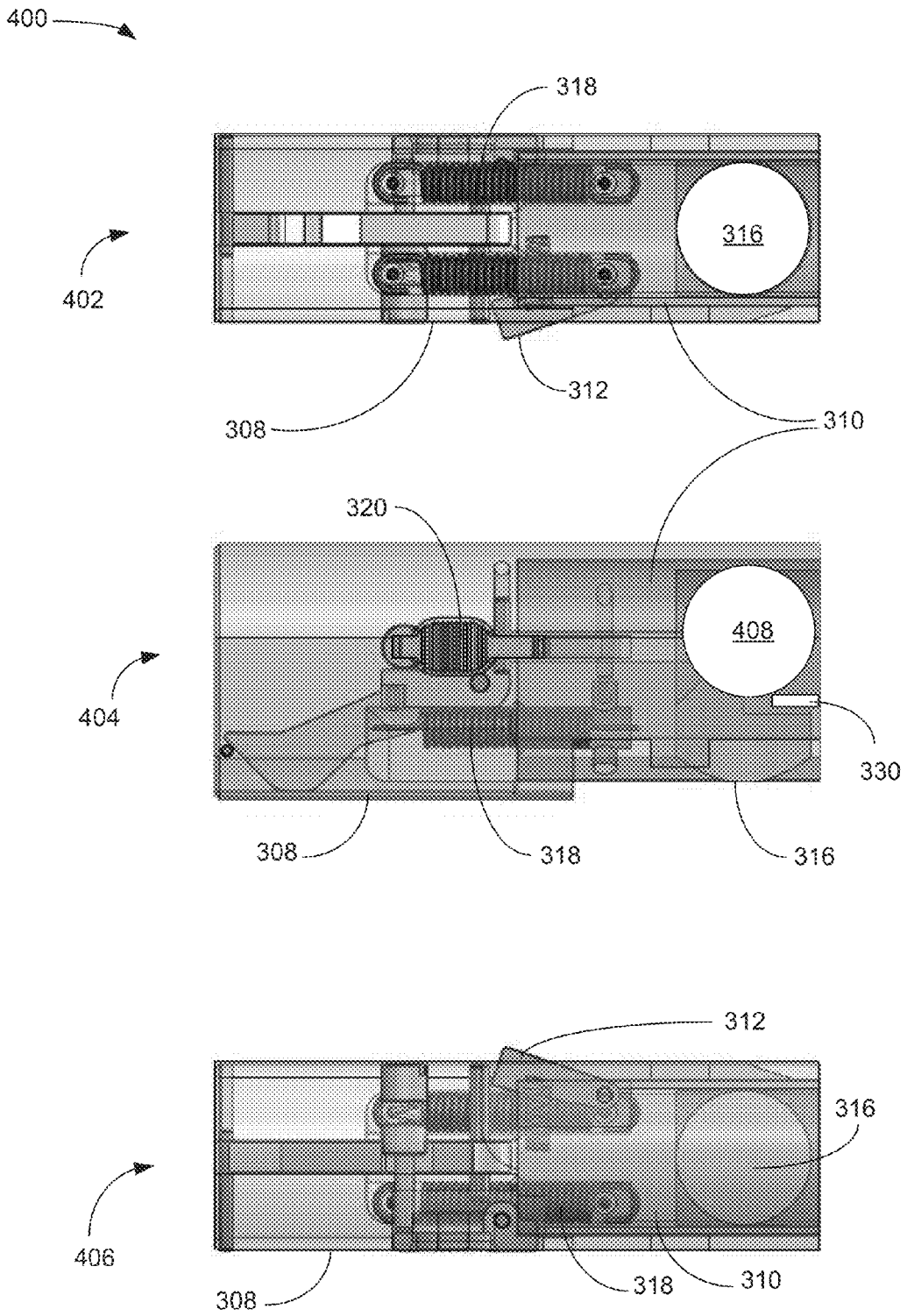
FIG. 4 illustrates an exemplary TCL device used to construct a shotgun-like projectile launcher in accordance with one embodiment of the present invention.

FIG. 4 is a diagram 400 illustrating a TCL device used to construct a shotgun-like projectile launcher in accordance with one embodiment of the present invention. Diagram 400 illustrates a bottom view of TCL device 402, a side view of TCL device 404, and a top view of TCL device 406. TCL device 402 or 404 or 406 includes a TCL frame 308 and a TCL extension 310. In one embodiment, the TCL device is connected to the forestock wherein the TCL device moves in response to the movement of forestock. For example, when the forestock is pumped, the TCL device reacts accordingly. TCL device 402, 404, or 406 illustrates a configuration in which TCL extension 310 can be completely situated inside of TCL frame 308. In one aspect, a loading door facilitates ammunition loading from external to the loading tube.

In one embodiment, the TCL device is able to open the loading door for loading projectiles in response to movement of the forestock. For example, when a forestock slides backward to a first distance, the launcher is cocked and a fresh projectile is loaded into the loading chamber. If the forestock continues to slide backward to a second (longer) distance, TCL extension 310 retracts inside of TCL frame 308 whereby a loading door is visibly open. After loading the projectiles into the loading tube, the forestock slides forward whereby the freshly loaded projectile is pushed from the loading chamber to the firing chamber preparing to launch. In one aspect, pre-chamber guide 330 is able to hold projectile 408 in place until the next loading occurs.

Figure 5:
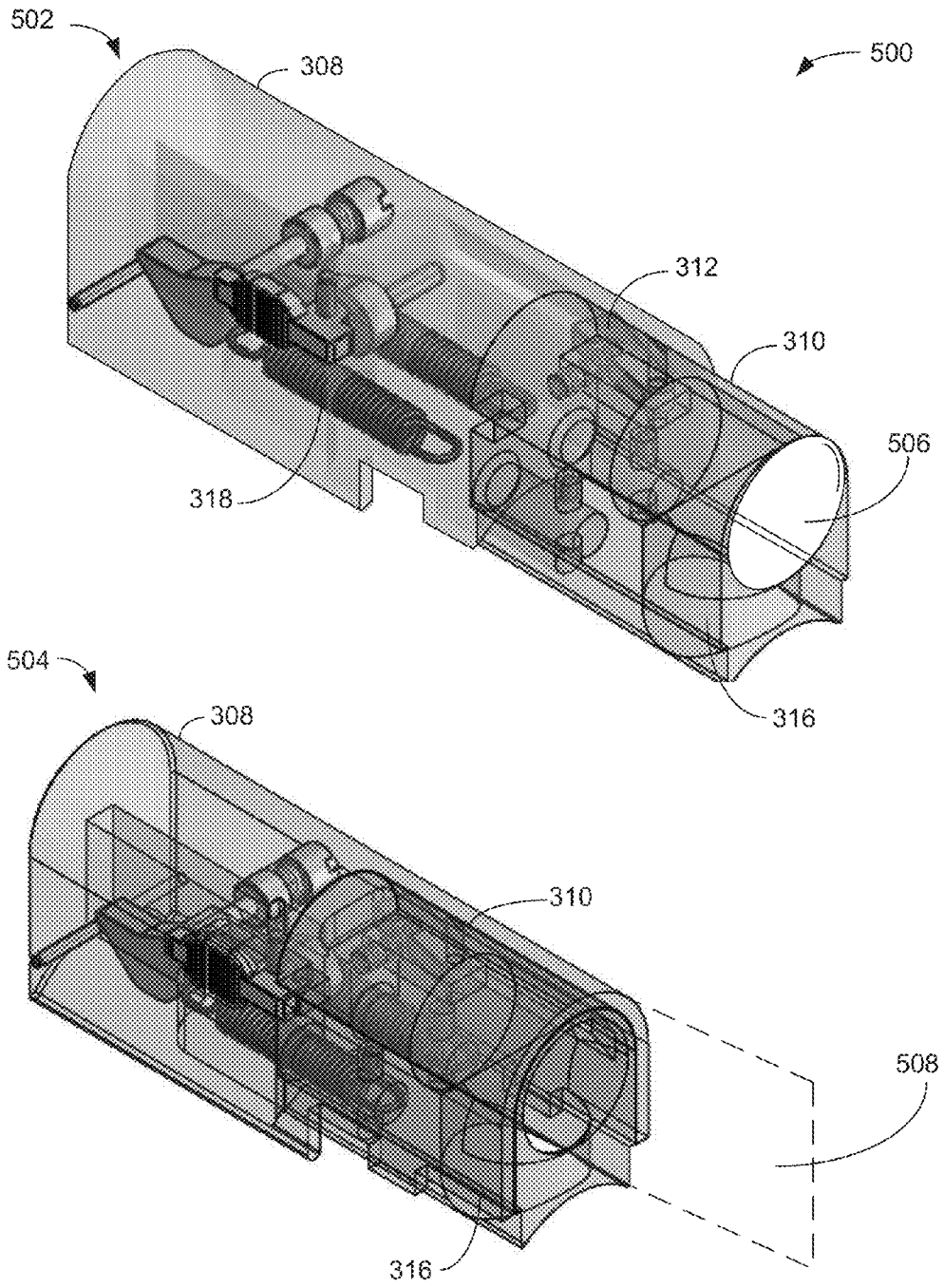
FIG. 5 is a three-dimensional ("3D") diagram illustrating a TCL device in accordance with one embodiment of the present invention.

FIG. 5 is a three-dimensional ("3D") diagram 500 illustrating a TCL device in accordance with one embodiment of the present invention. Diagram 500 illustrates a TCL device 502 that operates in stage one (1) operation and a TCL device 504 that operates in stage two (2) operation. TCL device 502 includes TCL frame 308 and TCL extension 310 wherein TCL extension 310 is fully extended from TCL frame 308. Note that TCL extension 310 includes a coupler 506 which may be removable coupled to the loading tube when the TCL device is in loading phase.

TCL device 504, on the other hand, illustrates a stage two (2) operation wherein TCL extension 310 is completely retracted into TCL frame 308. TCL device 504 also shows a loading door 508 which is used to load projectiles such as paintballs into the loading tube. Depending on applications, loading door 508 can be expended by moving or shifting additional portion of TCL device 504 into the receiver.

Figure 6A:
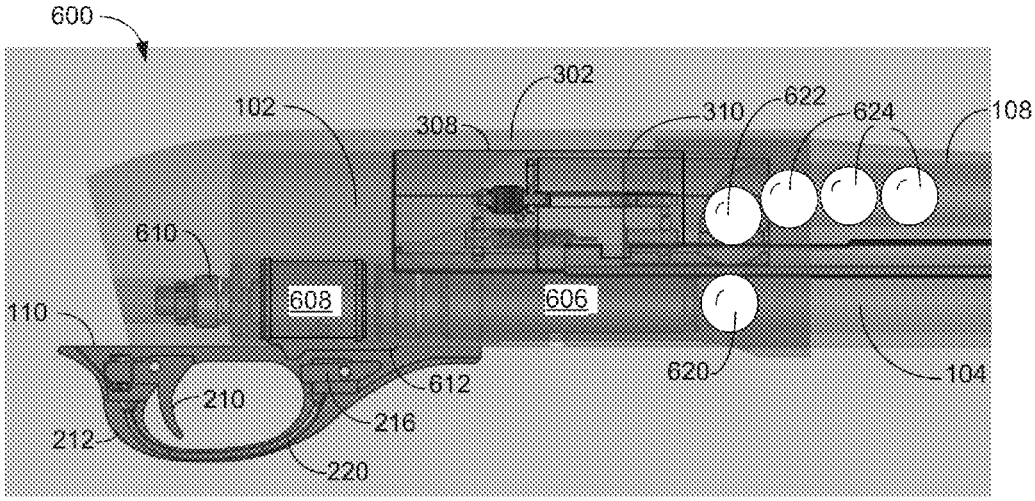
FIGS. 6A-D show a process of launching a projectile using a projectile launcher structured in a shotgun-like configuration in accordance with one embodiment of the present invention.

FIGS. 6A-D show a process of launching a projectile using a projectile launcher structured in a shotgun-like configuration in accordance with one embodiment of the present invention. It should be noted that the launcher can be a paintball marker. FIG. 6A illustrates a section of projectile launcher 600 having a receiver 102, a trigger mechanism 110, a loading tube 108, a barrel 104, and a TCL device 302. Loading tube 108 contains multiple projectiles such as paintballs 622-624. It should be noted that the underlying concept of the exemplary embodiment(s) of the present invention would not change if one or more components (or units) were added to or removed from launcher 600.

Receiver 102, in one embodiment, includes a valve 610, a striker 608, and a bolt 606 wherein valve 610, striker 608, and bolt 606 are arranged in a consecutive, succeeding, or linear sequential order. When the forestock moves or slides backward as conducting a first half pumping motion, a fresh paintball 620 is loaded into a loading chamber, and similarly, striker 608 is cocked or connected to bolt 606 via a sear 612. In one embodiment, the pre-chamber guide, not shown in FIG. 6A, is used to orient paintball 622 to face a correct direction.

Figure 6B:
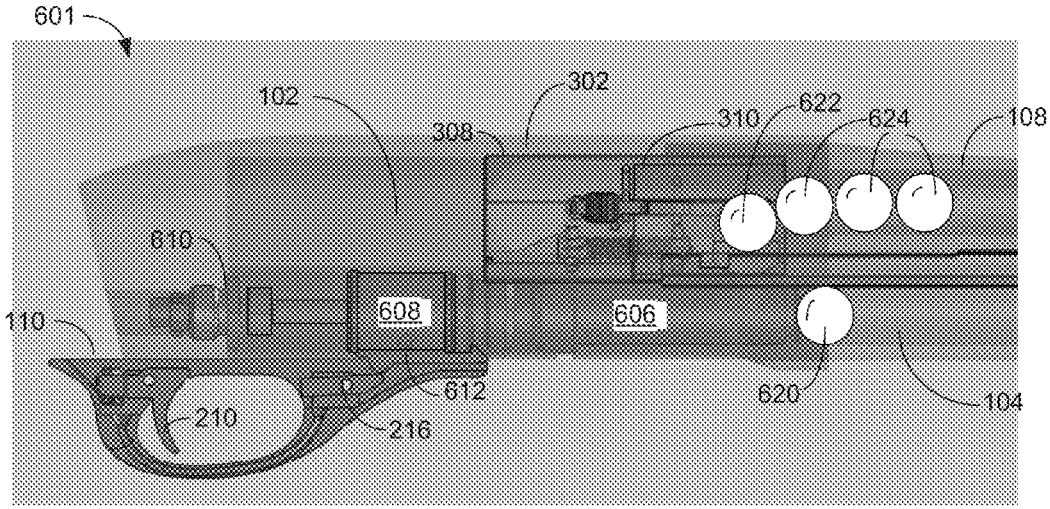

FIG. 6B illustrates a section of projectile launcher 601 having a receiver 102, a trigger mechanism 110, a loading tube 108, a barrel 104, and a TCL device 302. It should be noted that the operation illustrated in launcher 601 may be viewed as a continuation process of process of launcher 600. When the forestock slides forward to complete the second half pumping action, bolt 606, which is coupled with the forestock, moves forward as the movement of forestock and pushes paintball 620 from the loading chamber to the firing chamber. Since sear 612 couples to striker 608, bolt 606 cocks striker 608 to a ready-to-fire position.

Figure 6C:
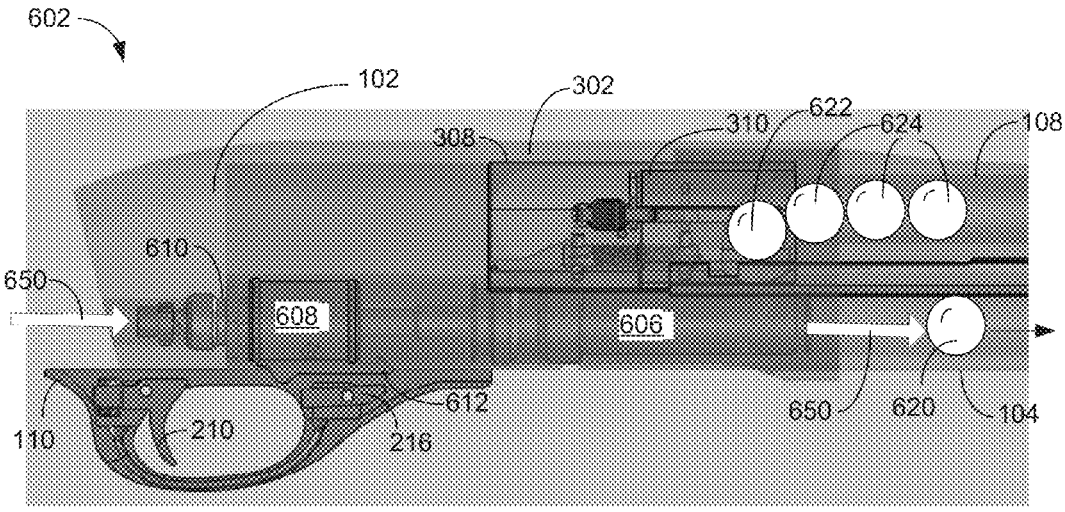

FIG. 6C illustrates a section of projectile launcher 602 having a receiver 102, a trigger mechanism 110, a loading tube 108, a barrel 104, and a TCL device 302. It should be noted that the operation illustrated in launcher 602 may be viewed as a continuation process of process of launcher 601. When trigger 210 is squeezed or pulled, trigger 210 activates latch 216 through trigger extension cable 220. The movement of latch 216 triggers or releases sear 612 which disconnects striker 608 from bolt 606. Upon disconnection, striker 608 hits or strikes valve 610. A predefined amount of pressurized gas 650 is allowed to pass through when valve 610 is momentarily open as striker 608 strikes valve 610. Paintball 620 is launched by pressurized gas 650 which is the amount of pressurized gas passing through the air channel located in the middle of bolt 606.

Figure 6D:
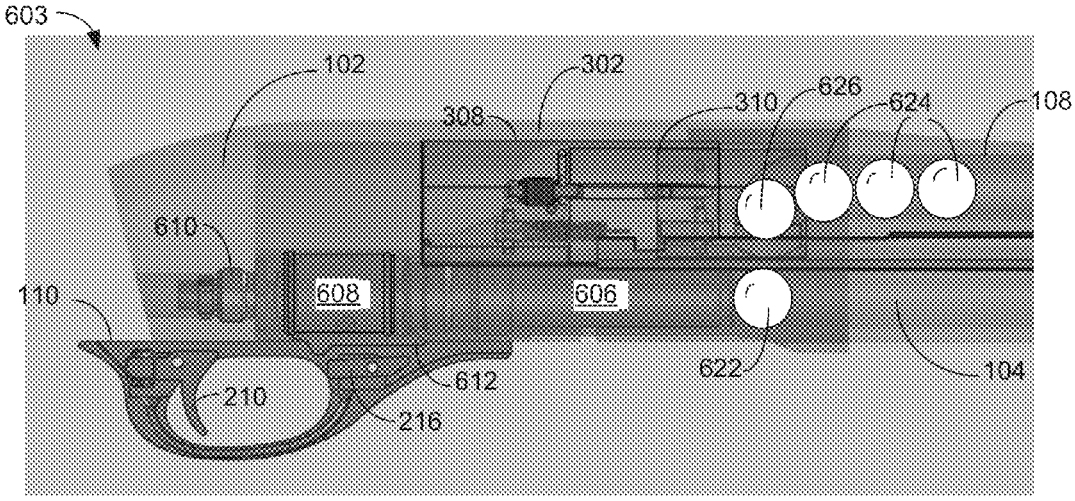

FIG. 6D illustrates a section of projectile launcher 603 having a receiver 102, a trigger mechanism 110, a loading tube 108, a barrel 104, and a TCL device 302. Noted that the operation illustrated in launcher 603 may be viewed as a continuation of the process of launcher 602. After launch of paintball 620 as described in FIG. 6C, the forestock is pumped and a fresh round of paintballs are reloaded. For example, paintball 622 is loaded into a loading chamber while paintball 626 is pushed from loading tube 108 into TCL device 302. The firing cycle repeats.

Figure 7A:
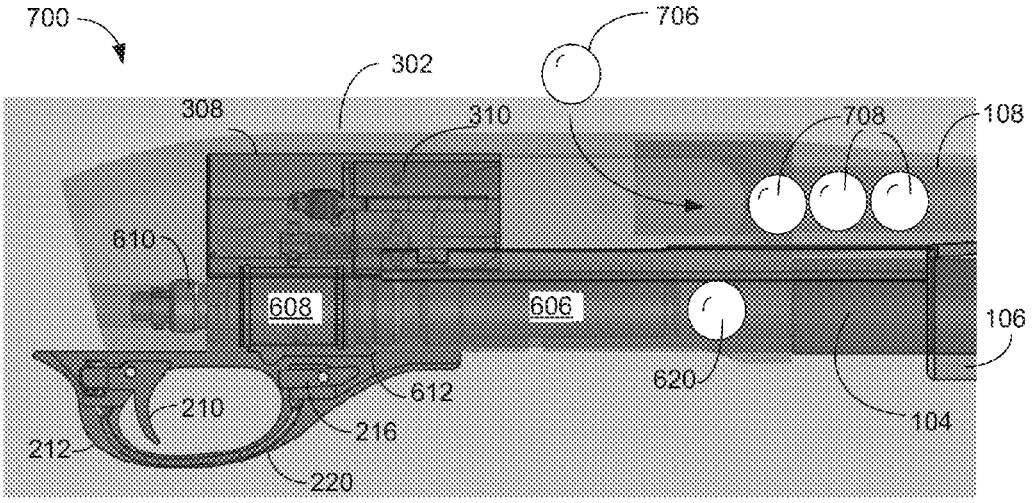
FIGS. 7A-B show TCL devices operating in different stages in accordance with one embodiment of the present invention.

FIG. 7A illustrates an exemplary TCL device 302 operating in a stage two (2) or loading operation in accordance with one embodiment of the present invention. In one embodiment, TCL device 302 is capable of moving toward backside of projectile launcher 700 to open the loading door. For example, paintball 706 can be loaded into loading tube 108 which already has multiple paintballs or projectiles 708 in the tube. Depending on the applications, the width of the loading door can be adjusted in accordance with the size of the projectiles.

Figure 7B:
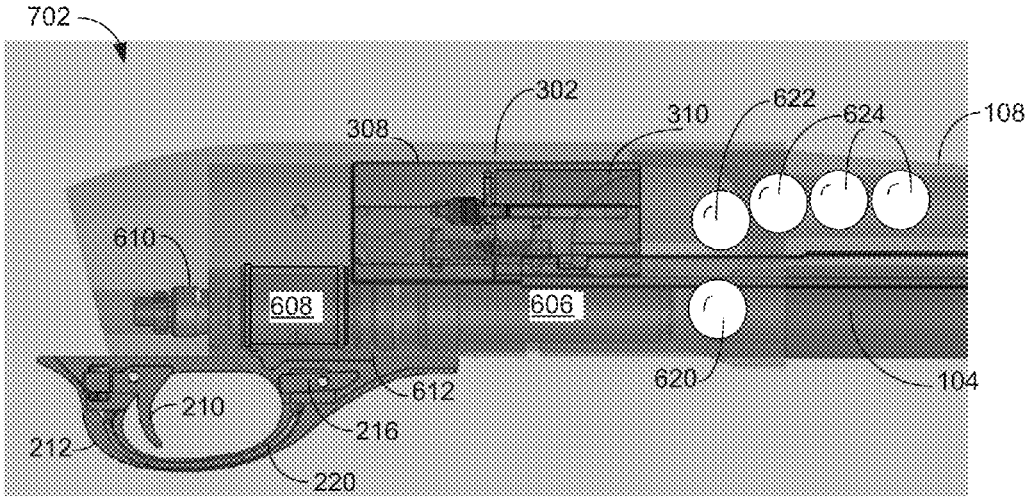

FIG. 7B shows an exemplary TCL device 302 operating in a stage one (1) operation in accordance with one embodiment of the present invention. Comparing launcher 700 in FIG. 7A, the TCL device in launcher 700 is situated further back toward the backside of launcher 700 than the TCL device in Launcher 702. As indicated earlier, the stage one (1) operation provides more rapid firing or launching while the stage two (2) operation provides a firing operation that resembles traditional shotgun operation.

Figure 8A:
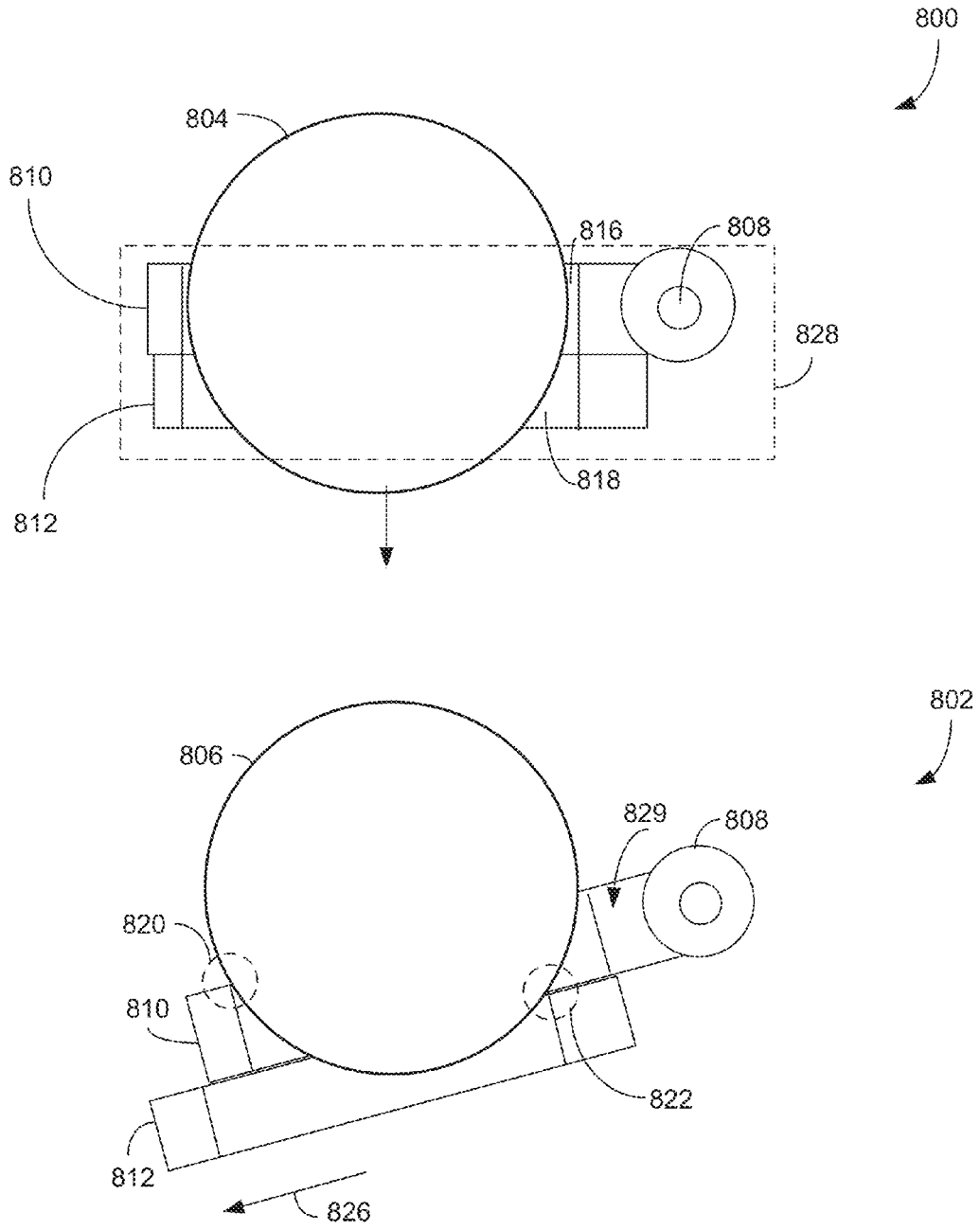
FIGS. 8A-D are diagrams illustrating a projectile trap used for projectile dispensing control which can be installed in a TCL device in accordance with one embodiment of the present invention.

FIGS. 8A-D show various diagrams illustrating a projectile trap used for controlling projectile dispensing used in a TCL device in accordance with one embodiment of the present invention. FIG. 8A, for example, depicts a diagram 800 illustrating a projectile such as a paintball 804 and a projectile trap 828. Projectile trap 828, in one embodiment, includes a stationary ring 810, a moving ring 812, and a pivotal hole 808, wherein pivotal hole 808 together with a pin (not shown in FIG. 8A) may be used to attach projectile trap 828 to a frame or structure of TCL device.

Stationary ring 810 includes a stationary hole 816 wherein the diameter of stationary hole 816 should be slightly greater than the diameter of projectile 804 so that projectile 804 can smoothly pass through stationary hole 816. Moving ring 812 includes a moving hole 818 wherein the diameter of moving hole 818 should also be slightly greater than the diameter of projectile 804 whereby projectile 804 can pass through moving hole 816 smoothly. In one aspect, projectile trap 828 is situated between the loading storage and loading chamber functioning. In one example, projectile trap 828 is used as a gate keeper that prevents more than one projectiles can pass through projectile trap 828 at a given time. As such, projectile trap 828 may be installed adjacent to the loading port used for dispense one projectile at a giving time.

During loading operation, projectile trap 828 is orientated in such a way that stationary ring 810 and moving ring 812 are aligned. When rings 810-812 are aligned, projectile 804 passes from stationary hole 816 and moving hole 818 to the loading chamber. After projectile 804 passes through projectile trap 828, projectile trap 828 tilts in a direction indicated by arrow 829, as shown in diagram 802. When projectile trap 828 tilts with respect to pivotal hole 808 as indicated by arrow 829, moving ring 812 slides in a direction indicated by arrow 826. After moving ring 812 slides, stationary ring 810 and moving ring 810 are no longer aligned. Once stationary ring 810 and moving ring 810 are misaligned, projectile 806 will not be able to pass projectile trap 828 because the diameter between points 820-822 is smaller than the diameter of projectile 806. As such, projectile 806 is trapped by projectile trap 828 until the orientation of projectile trap 828 changes.

An advantage of using projectile trap 828 is that it is able to dispense one projectile at a given time.

Figure 8B:
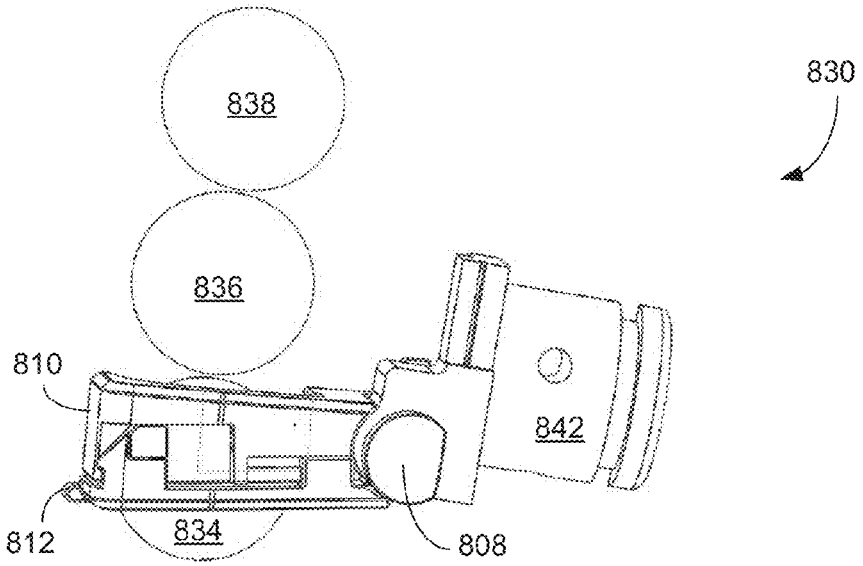
Figure 8B:
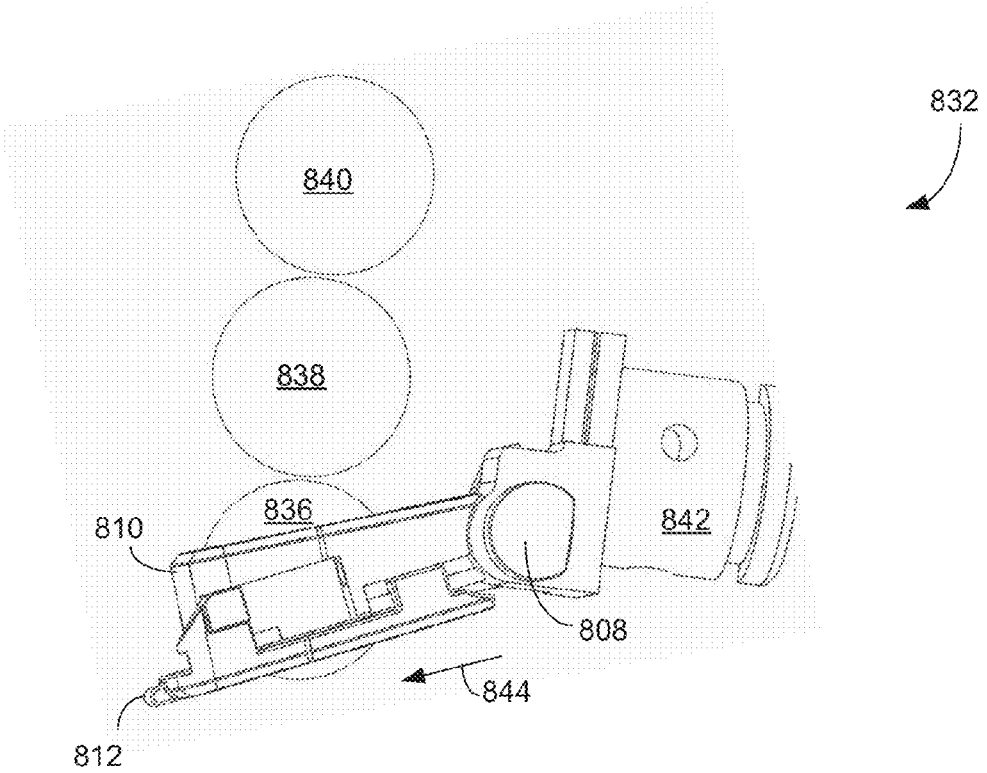

FIG. 8B shows diagrams 830-832 wherein diagram 830 illustrates the projectile trap is in an orientation allowing paintballs 834-838 to pass. Note that pivotal hole 808 is used to attach the projectile trap to a structure 842 via a pin. Stationary ring 810 includes tracks or lips allowing moving ring 812 to slide within a predefined limited distance for trapping. Diagram 832 illustrates the projectile trap that is in an orientation to trap or block paintballs 836-840 from passing through the projectile trap. It should be noted that moving ring 812 is moved in a direction indicated by arrow 844 in response to the tilted orientation of projectile trap.

Figure 8C:
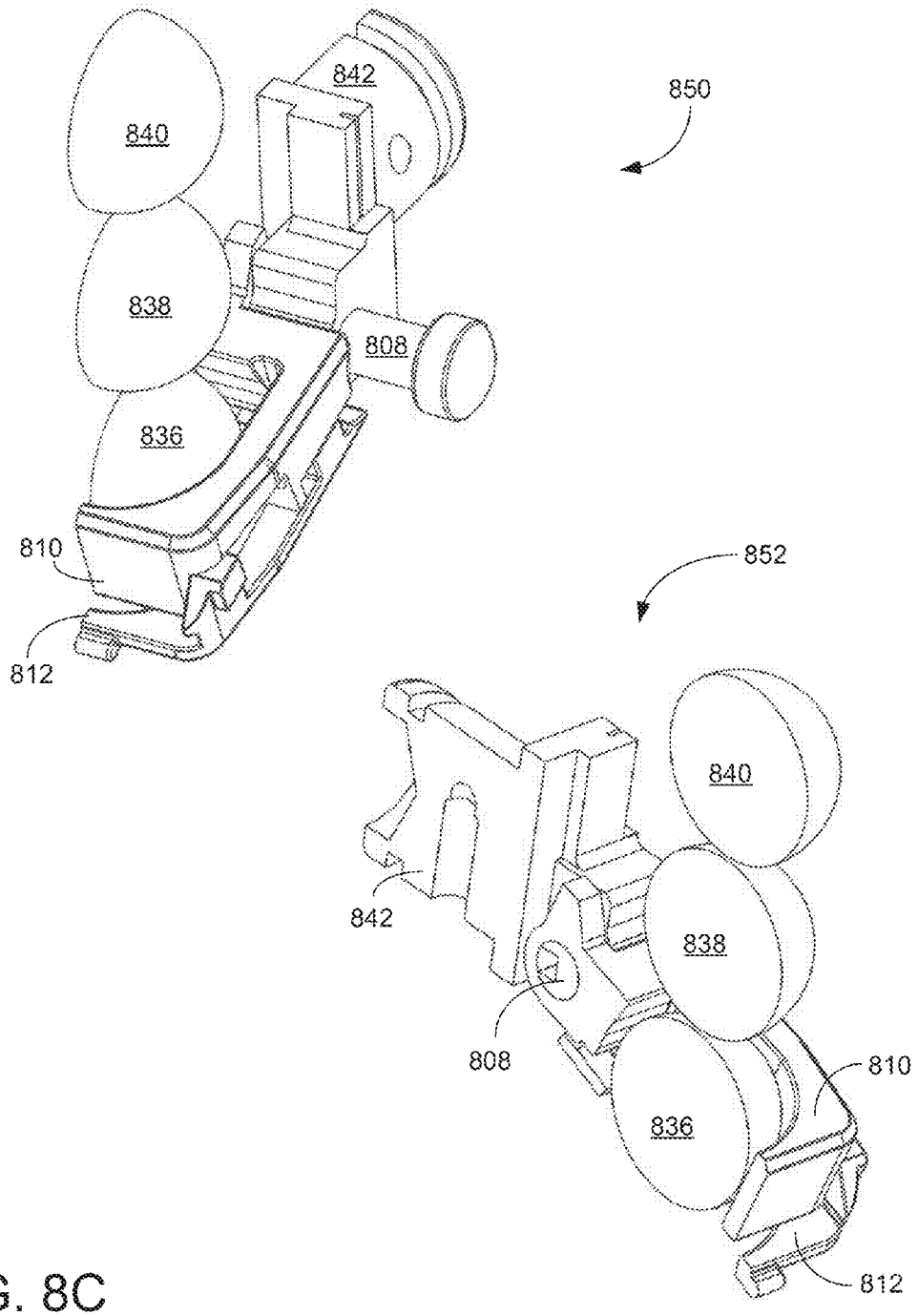
Figure 8D:
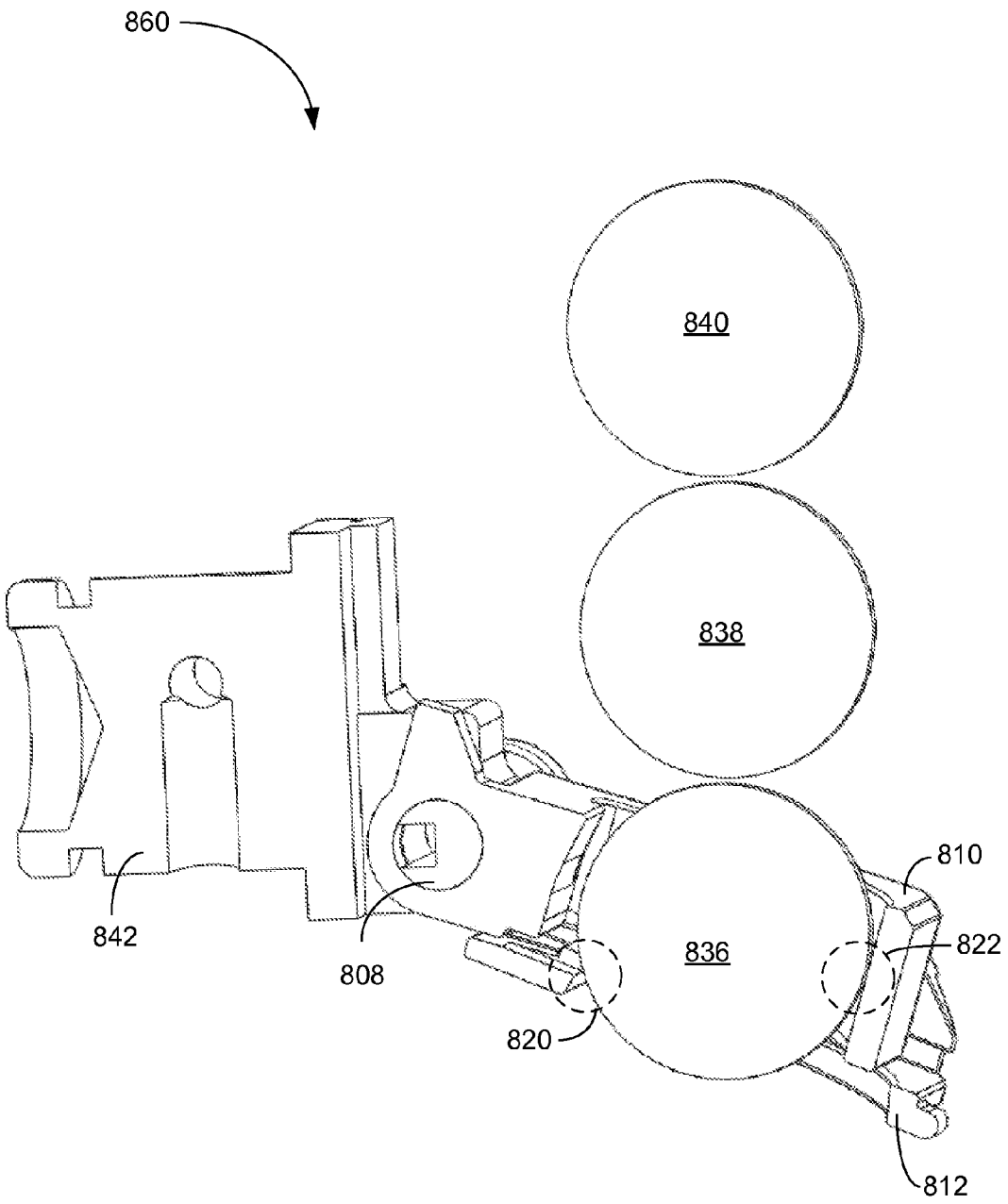

FIG. 8C shows a three-dimensional ("3D") diagram 850-852 showing a perspective view of projectile trap wherein three projectiles 836-840 are trapped. FIG. 8D shows a cut-open or cross-view diagram 860 showing inside of projectile trap which is situated in an orientation that is able to trap projectiles or paintballs. It should be noted that the underlying concept of the exemplary embodiment(s) of the present invention would not change if one or more components (or units) were added to or removed from the projectile trap.

Figure 9:
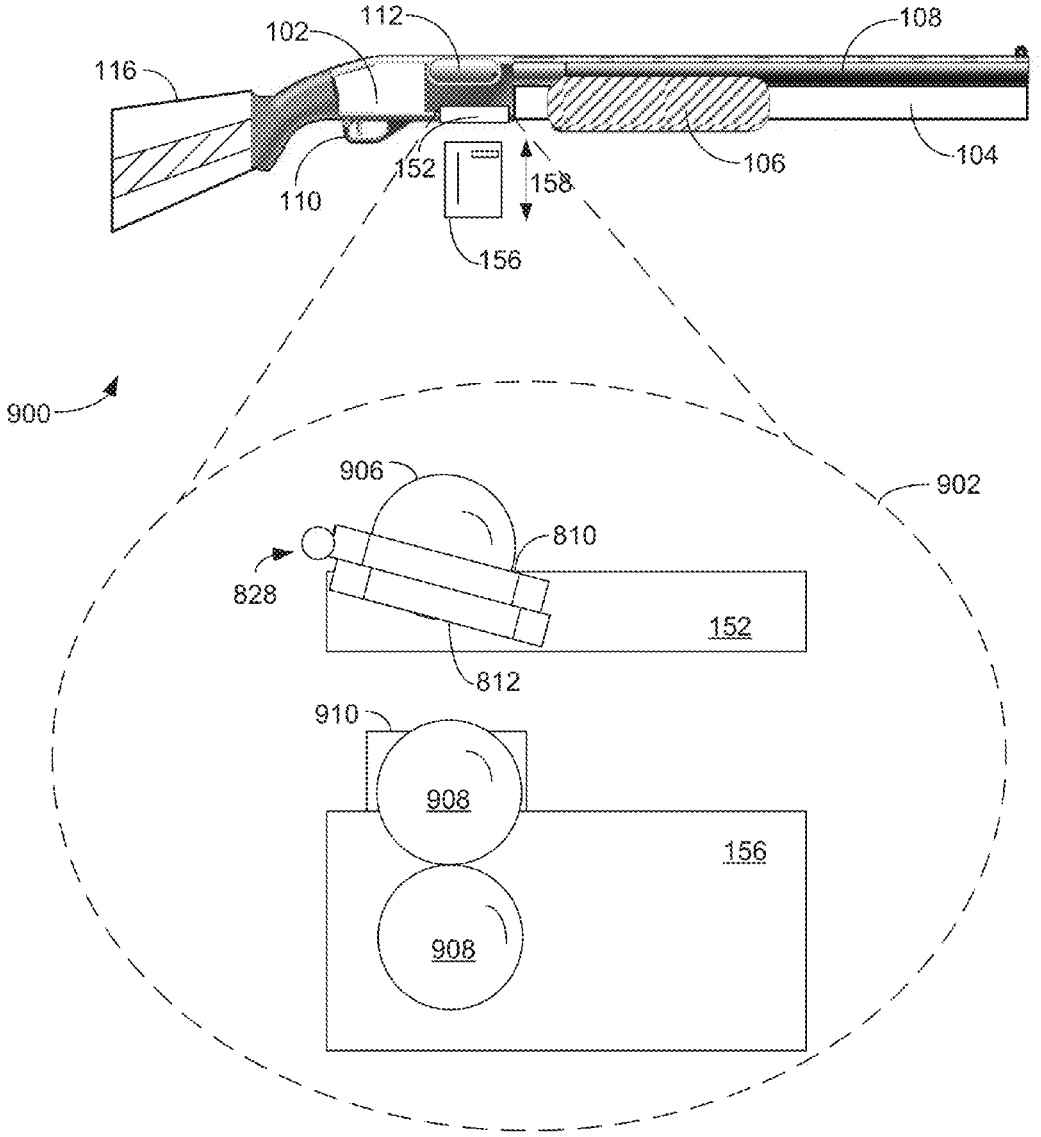
FIG. 9 is diagram illustrating a projectile trap used with a projectile launcher for projectile dispensing control in accordance with one embodiment of the present invention.

FIG. 9 is diagram 900 illustrating a projectile trap 828 used with a projectile launcher for projectile dispensing control in accordance with one embodiment of the present invention. The projectile launching device such as a paintball assembly includes a receiver, an ammunition magazine or magazine 156, a magazine well 152, and a trap 828. The receiver includes magazine well 152 having a magazine receiving port, a loading chamber, and a launching mechanism. The receiver which can be the body of a paintball assembly is configured to launch a projectile using pressurized gas. Ammunition magazine 156 includes a projectile supply port 910 and a body which is able to store multiple projectiles such as paintballs or objects. Projectile supply port 910, in one example, is configured to insert into the magazine receiving port of the receiver for supplying projectiles 906-908 from ammunition magazine 156 to the loading chamber of the receiver.

Trap 828 is situated at a vicinity of the loading chamber and magazine receiving port nearby magazine well 152. In one embodiment, when ammunition magazine 156 is removed from the receiver as shown in FIG. 9, trap 828 is oriented in a trap orientation which prevents projectile such as 906 from leaving the loading chamber through the magazine receiving port. Trap 828 includes a top plate 810 having a top hole and a bottom plate 812 having a bottom hole. When ammunition magazine 156 is inserted in the receiver, trap 828 is oriented in a loading position which allows a projectile(s) such as paintball 906 to pass from magazine 156 to the load chamber via the top and bottom holes of top and bottom plates 810-812. When trap 828 is oriented in a trap orientation, bottom plate 812 slides along a rail fixed on top plate 810 so that the top hole and the bottom hole are misaligned. The misalignment between the top hole and bottom hole keeps the projectile such as paintball 906 in the loading chamber.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A projectile launching device comprising:

a receiver configured to house a valve, a striker, and a bolt and configured to launch a projectile via pressurized gas;

a loading tube coupled to a top side of the receiver and able to store a predefined number of projectiles for launching;

a trigger mechanism coupled to a bottom side of the receiver and configured to include a trigger and a trigger guard wherein the trigger guard includes a cable channel; and a two-stage cocking and loading ("TCL") device coupled to the loading tube and configured to set the striker at a firing position, wherein the TCL device includes a loading door, a pre-chamber loader, and a cocking element wherein the cocking element is able to cock the striker to a ready-to-fire position.

2. The device of claim 1, further comprising a trigger extension cable passing through the channel of the trigger guard and configured to provide a flexible linkage between the trigger and a latch wherein the latch is able to release a sear for launching the projectile.

3. The device of claim 2, further comprising a forestock coupled to a barrel connected to the receiver, and configured to provide a linkage to the TCL device for cocking and loading actions.

4. The device of claim 3, wherein the forestock provides a grip allowing a user to grab the grip of the forestock and move along the barrel for cocking the striker.

5. The device of claim 3, wherein the forestock provides a grip allowing a user to grab the grip of the forestock and move along the barrel for loading a plurality of paintballs.

6. The device of claim 2, wherein the trigger extension cable includes a first end, a second end, and a body, wherein the first end is connected to the trigger and the second end is connected to the latch, wherein the body of the trigger extension cable is embedded in the cable channel.

7. The device of claim 6, wherein the trigger, the trigger guard, the trigger extension cable, the latch, and the sear are arranged in such a way that when the trigger is squeezed which pulls the trigger extension cable through the trigger guard, the latch triggers the sear to launch a paintball.

8. A projectile launcher, comprising:

a receiver configured to house a valve, a striker, and a bolt, and configured to launch a projectile via pressurized gas;

a loading tube coupled to a top side of the receiver and able to store a predefined number of projectiles for launching;

a two-stage cocking and loading ("TCL") device coupled to the loading tube and configured to providing cocking function, wherein the TCL device further includes a loading door, a pre-chamber loader, and a cocking element wherein the cocking element is able to cock the striker to a ready-to-fire position.

9. The device of claim 8, wherein the TCL device further includes, a stage 1(one) configured to constrain a first travel distance of a forestock over a barrel within a first predefined limitation; and a stage 2(two) configured to constrain a second travel distance of the forestock within a second predefined limitation.

10. The device of claim 9, wherein the TCL device is configured to open the loading door for loading projectiles in response to a movement of the forestock.

11. The device of claim 8, further comprising a forestock coupled to a barrel connected to the receiver, and configured to provide a linkage to the TCL device for cocking and loading actions.

12. The device of claim 9, wherein the forestock provides a grip allowing a user to grab the grip of the forestock and move along the barrel for cocking the striker.

13. The launcher of claim 8, further includes a trigger mechanism coupled to bottom side of the receiver and configured to include a trigger and a trigger guard wherein the trigger guard includes a cable channel; and a trigger extension cable passing through the channel of the trigger guard and configured to provide a flexible linkage between the trigger and a latch wherein the latch is able to release a sear for launching the projectile.

14. A projectile launching device comprising:

a receiver configured to house a valve, a striker, and a bolt and configured to launch a projectile via pressurized gas;

a loading tube coupled to a top side of the receiver and able to store a predefined number of projectiles for launching; and a two-stage cocking and loading ("TCL") device coupled to the loading tube and configured to providing cocking function, wherein the TCL device includes a loading door, a pre-chamber loader, and a cocking element wherein the cocking element is able to cock the striker to a ready-to-fire position.

15. The device of claim 14, further comprising a trigger mechanism coupled to a bottom side of the receiver and configured to include a trigger and a trigger guard wherein the trigger guard includes a cable channel; and a trigger extension cable passing through the channel of the trigger guard and configured to provide a flexible linkage between the trigger and a latch wherein the latch is able to release a sear for launching the projectile.

16. The device of claim 15, further comprising a forestock coupled to a barrel connected to the receiver, and configured to provide a linkage to the TCL device for cocking and loading actions.

17. The device of claim 16, wherein the forestock provides a grip allowing a user to grab the grip of the forestock and move along the barrel for cocking the striker.

18. The device of claim 16, wherein the forestock provides a grip allowing a user to grab the grip of the forestock and move along the barrel for loading a plurality of paintballs.

19. A paintball marker, comprising a two-stage cocking and loading ("TCL") device coupled to a loading tube and configured to providing a cocking function, the TCL device including a loading door, a pre-chamber loader, and a cocking element wherein the cocking element is able to cock the striker to a ready-to-fire position, wherein the TCL device further includes, a stage 1(one) configured to constrain a first travel distance of a forestock over a barrel within a first predefined limitation; and a stage 2(two) configured to constrain a second travel distance of the forestock within a second predefined limitation.

20. The marker of claim 19, wherein the TCL device is configured to open the loading door for loading projectiles in response to a movement of the forestock.

21. The marker of claim 19, wherein the forestock is coupled to the barrel connected to a receiver, and configured to provide a linkage to the TCL device for cocking and loading actions.

22. The marker of claim 19, further comprising:

a trigger mechanism coupled to a bottom side of the receiver and configured to include a trigger and a trigger guard wherein the trigger guard includes a cable channel; and a trigger extension cable passing through the channel of the trigger guard and configured to provide a flexible linkage between the trigger and a latch wherein the latch is able to release a sear for launching the projectile.

* * * * *